United States Patent [19]

Morigaki et al.

[11] Patent Number: 4,486,528

[45] Date of Patent: Dec. 4, 1984

[54] COLOR DIFFUSION TRANSFER PHOTOGRAPHIC ELEMENT WITH REDOX DYE RELEASERS

[75] Inventors: Masakazu Morigaki; Motohiko Tsubota, both of Kanagawa, Japan

[73] Assignee: Fuji Photo Film Co., Ltd., Kanagawa, Japan

[21] Appl. No.: 470,355

[22] Filed: Feb. 28, 1983

Related U.S. Application Data

[63] Continuation of Ser. No. 276,299, Jun. 22, 1981, abandoned.

[30] Foreign Application Priority Data

Jun. 20, 1980 [JP] Japan ..... 55-83528

[51] Int. Cl.[3] ..... G03C 5/54; G03C 7/00; G03C 1/40

[52] U.S. Cl. ..... 430/218; 430/487

[58] Field of Search ..... 430/218, 223, 217, 239, 430/242, 446, 487, 598, 559, 409

[56] References Cited

U.S. PATENT DOCUMENTS

| | | | |
|---|---|---|---|
| 2,648,604 | 8/1953 | Welliver et al. | 430/487 |
| 2,685,514 | 8/1954 | Haist et al. | 430/409 |
| 3,173,786 | 3/1965 | Green et al. | 430/218 |
| 3,253,915 | 5/1966 | Weyerts et al. | 430/218 |
| 3,443,940 | 5/1969 | Bloom et al. | 430/223 |
| 3,649,265 | 3/1972 | Stewart | 430/218 |
| 4,135,931 | 1/1979 | Yoneyama et al. | 430/446 |
| 4,255,511 | 3/1981 | Hirano et al. | 430/223 |

OTHER PUBLICATIONS

Vanselow et al., "Influence of Quaternary Salts . . . ", *Photo. Sci. and Technique,* 1953, pp. 36–39.

"Photographic Processes and Products", *Research Disclosure,* No. 15162, 11/1976, pp. 76–87.

*Primary Examiner*—Richard L. Schilling

*Attorney, Agent, or Firm*—Sughrue, Mion, Zinn, Macpeak, and Seas

[57] ABSTRACT

A color diffusion transfer photographic element which comprises (a) a light-sensitive element containing at least one light-sensitive silver halide emulsion layer associated with a dye releasing redox compound, (b) a dye image receiving element and (c) an alkaline processing composition element, wherein the improvement comprises said alkaline processing composition element containing (1) a developing agent having one-electron oxidation reduction potential in the range of from −80 mV to −200 mV with respect to a saturated calomel electrode at a pH of 11.0 and (2) at least one compound selected from the group consisting of compounds represented by following general formula (I) or (II)

(I)

(II)

wherein A and B each represents a non-metallic atomic group necessary to form a 5-, 6- or 7-membered ring; $R_1$, $R_3$ and $R_4$ each represents an alkyl group, a substituted alkyl group, an alkenyl group, an aryl group or a substituted aryl group, $R_1$ may further represent and $R_4$ may further represent wherein Y represents a divalent group; $R_2$ represents a hydrogen atom, an alkyl group, a substituted alkyl group, an aryl group, a substituted aryl group, an alkoxy group, and aryloxy group, an alkylthio group or an arylthio group, with the proviso that $R_2$ is not a methyl group when the compound represented by general formula (I) is a pyridinium salt; and $X^{\ominus}$ represents an anion, with the proviso that $X^{\ominus}$ is not present when an inner salt is formed, wherein $R_3$ may further connect with the ring formed with B to form a biscyclo ring system.

29 Claims, No Drawings

COLOR DIFFUSION TRANSFER PHOTOGRAPHIC ELEMENT WITH REDOX DYE RELEASERS

This is a continuation of application Ser. No. 276,299, filed June 22, 1981 now abandoned.

FIELD OF THE INVENTION

The present invention relates to color photographic elements and, particularly, to color diffusion transfer photographic elements.

BACKGROUND OF THE INVENTION

In color diffusion transfer photographic elements, a method of effectively obtaining good image density is one very important object for the purpose of, for example, (a) obtaining sharp images, (b) obtaining images as rapidly as possible by reducing the thickness of the photographic light-sensitive material as far as possible, (c) improving sharpness by reducing the thickness of the layer of the photographic element as far as possible as per (b) to shorten of the diffusion distance or (d) producing color diffusion transfer photographic elements at low price, etc.

For color diffusion transfer photographic elements using a silver halide developing agent capable of causing cross-oxidation of a dye releasing redox compound, a method of increasing the activity of a silver halide developing agent capable of causing cross-oxidation of the above-described dye releasing redox compound, namely, a method using the above-described silver halide developing agent having a low oxidation reduction potential, is known as one method of rapidly obtaining images. However, since a silver halide developing agent having a low oxidation reduction potential is used, cross-oxidation of the dye releasing redox compound with a one-electron oxidation product of the silver halide developing agent is difficult to effect and, consequently, sufficient image density is difficult to obtain.

Specifically, when a silver halide developing agent having a low oxidation reduction potential is used, the development rate of the coated silver halide is high but cross-oxidation of the oxidation product of the silver halide developing agent with the dye releasing redox compound does not sufficiently advance and, consequently, images having sufficient density cannot be obtained.

SUMMARY OF THE INVENTION

An object of the present invention is to provide a color diffusion transfer photographic element which rapidly forms images having high image density using a silver halide developing agent having a low oxidation reduction potential.

Another object of the present invention is to provide an alkaline processing composition for increasing image density and/or shortening the time for image formation in a color diffusion transfer photographic element.

The above-described objects are attained with a color diffusion transfer photographic element which comprises (a) a light-sensitive element containing at least one light-sensitive silver halide emulsion layer associated with a dye releasing redox compound, (b) a dye image receiving element and (c) an alkaline processing composition element, wherein the improvement comprises said alkaline processing composition element containing (1) a developing agent having a one-electron oxidation reduction potential in the range of from −80 mV to −200 mV with respect to a saturated calomel electrode at a pH of 11.0 and (2) at least one compound selected from the group consisting of compounds represented by the following general formula (I) or (II)

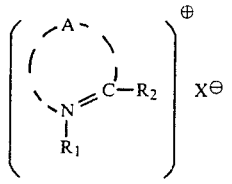

(I)

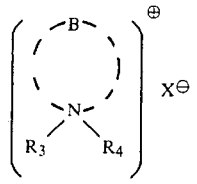

(II)

wherein A and B each represents a non-metallic atomic group necessary to form a 5-, 6- or 7-membered ring; $R_1$, $R_3$ and $R_4$ each represents an alkyl group, a substituted alkyl group, an alkenyl group, an aryl group or a substituted aryl group, $R_1$ may further represent

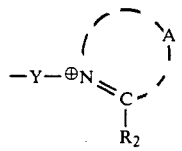

and $R_4$ may further represent

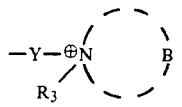

wherein Y represents a divalent group; $R_2$ represents a hydrogen atom, an alkyl group, a substituted alkyl group, an aryl group, a substituted aryl group, an alkoxy group, an aryloxy group, an alkylthio group or an arylthio group, with the proviso that $R_2$ is not a methyl group when the compound represented by general formula (I) is a pyridinium salt; and $X^{\ominus}$ represents an anion, with the proviso that $X^{\ominus}$ is not present when an inner salt is formed, wherein further $R_3$ may connect with the ring formed with B to form a biscyclo ring system.

DETAILED DESCRIPTION OF THE INVENTION

In the above-described general formulae (I) and (II), A and B each represents a non-metallic atomic group necessary to form a 5-, 6- or 7-membered ring. The non-metallic atomic group is composed of 3 to 6 atoms selected from carbon atoms, oxygen atoms, sulfur atoms and nitrogen atoms. Specific examples of A include

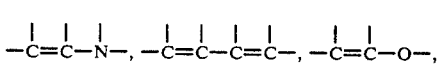

-continued

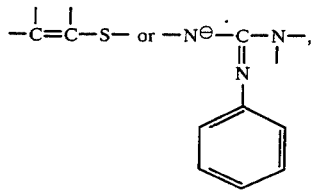

etc. Specific examples of B include a tetramethylene group, a pentamethylene group, a pentenylene group or

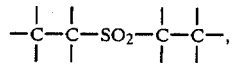

etc.

In the above-described general formulae (I) and (II), $R_1$, $R_3$ and $R_4$ each represents an alkyl group or a substituted alkyl group, and preferably an alkyl group having 1 to 20 carbon atoms (for example, a methyl group, an ethyl group, an n-propyl group, an isopropyl group, an n-butyl group, a tert-butyl group, a cyclohexyl group, a decyl group, a dodecyl group or a hexadecyl group, etc.). The alkyl group may be substituted with one or more substituents (up to 3 substituents) selected from a halogen atom (for example, a fluorine atom, a chlorine atom or a bromine atom, etc.), an aryl group or a substituted aryl group (for example, a phenyl group, a 4-methylphenyl group, a 2-chlorophenyl group, a 3-methoxyphenyl group, a 2-methyl-4-cyanophenyl group, a 2-methyl-4-nitrophenyl group or a dodecylphenyl group, etc.), a hydroxy group, a sulfonamino group, an alkoxy group (for example, a methoxy group, an isopropoxy group, a tert-butoxy group or a cyclohexyloxy group, etc.), an aryloxy group (for example, a phenoxy group, a 4-methylphenoxy group, a 3-methoxyphenoxy group or a 3,5-dimethylphenoxy group, etc.), an alkylthio group (for example, a methylthio group, an ethylthio group or an octylthio group, etc.), an arylthio group (for example, a phenylthio group or a 4-methylphenylthio group, etc.), an acyl group, an acylamino group, a carboxy group, a nitro group, a cyano group, etc. Specific examples of the substituted alkyl group include, for example, a β-hydroxyethyl group, a 2-chloroethyl group, a 2-bromoethyl group, a benzyl group, a p-dodecylphenylmethyl group or a 3-(perfluorooctadecanesulfonamido)propyl group, a methoxyethyl group, etc.

$R_1$, $R_3$ and $R_4$ each represents further an alkenyl group (for example, a vinyl group, an allyl group or a 5-octenyl group, etc.), an aryl group or a substituted aryl group. The aryl group may be substituted with one or more substituents (up to 3 substituents) selected from an alkyl group (for example, a methyl group, an ethyl group, an isopropyl group, a tert-butyl group, etc.), a halogen atom (for example, a chlorine atom, a bromine atom, etc.), a nitro group, a cyano group, an alkoxy group (for example, a methoxy group, an ethoxy group, etc.), an aryloxy group (for example, a phenoxy group, etc.), an alkylthio group (for example, a methylthio group, etc.), an arylthio group (for example, a phenylthio group, etc.), an acyl group, an acylamino group, a carboxyl group, a hydroxy group, etc. Specific examples of the aryl group and the substituted aryl group include, for example, a phenyl group, a 4-methylphenyl group, a 4-chlorophenyl group, a 2-methoxyphenyl group, a 3-hydroxy-2-methylphenyl group or a 3-methyl-4-nitrophenyl group, etc.

Furthermore, $R_1$ may represent

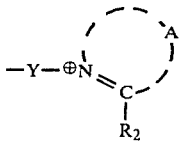

and $R_4$ may represent

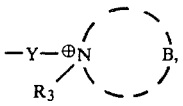

wherein Y represents a divalent group including an alkylene group (for example, a methylene group, an ethylene group, a butylene group or a pentamethylene group, etc.), an arylene group (for example, a phenylene group, etc.), an alkenylene group (for example, a pentenylene group, etc.),

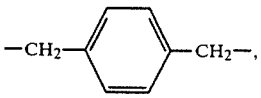

or the like. The alkylene group for Y preferably has 1 to 10 carbon atoms. The arylene group for Y preferably has 6 to 12 carbon atoms. The alkenylene group for Y preferably has 2 to 10 carbon atoms.

In the above-described general formulae (I) and (II), $R_2$ represents a hydrogen atom, an alkyl group or a substituted alkyl group, and preferably an alkyl group having 1 to 20 carbon atoms (for example, a methyl group, an ethyl group, an isopropyl group, a tert-butyl group, a cyclohexyl group, a dodecyl group or a hexadecyl group, etc.). The alkyl group may be substituted with one or more substituents selected from a halogen atom (for example, a chlorine atom or a bromine atom, etc.), an aryl group or a substituted aryl group (for example, a phenyl group, a 4-methylphenyl group, a 2-chlorophenyl group or a 2-methyl-4-nitrophenyl group, etc.), a hydroxy group, an alkoxy group (for example, a methoxy group, an isopropoxy group or a cyclohexyloxy group, etc.), an aryloxy group (for example, a phenoxy group, a 4-methylphenoxy group, a 3,5-dimethylphenoxy group or a 3-methoxyphenoxy group, etc.), an alkylthio group (for example, a methylthio group or an ethylthio group, etc.), an arylthio group (for example, a phenylthio group or a 4-methoxyphenylthio group, etc.), an acyl group, a nitro group, a cyano group or a carboxy group, etc. Specific examples of the substituted alkyl groups include, for example, a hydroxymethyl group, a benzyl group, a 2-chloroethyl group or a methoxyethyl group, etc.

$R_2$ further represents an aryl group or a substituted aryl group (for example, a phenyl group, a 4-methylphenyl group, a 2-chlorophenyl group, a 3-methoxyphenyl group, a 2-methyl-4-cyanophenyl group, a 2-methyl-4-nitrophenyl group or a dodecylphenyl group, etc.), an alkoxy group (for example, a methoxy group, an isopropoxy group or a cyclohexyloxy group, etc.), an aryloxy group (for example, a phenoxy group, a 4-tertbutylphenoxy group, a 4-chlorophenoxy group or a 3-methylphenoxy group, etc.), an alkylthio group (for example, a methylthio group, an ethylthio group or an octylthio group, etc.), or an arylthio group (for example, a phenylthio group or a 4-methoxyphenylthio group, etc.). However, when the compound represented by the general formula (I) is a pyridinium salt, $R_2$ is not a methyl group.

Referably $R_2$ is a hydrogen atom or an alkyl group having 1 to 20 carbon atoms.

In the above-described general formulae (I) and (II), $X^{\ominus}$ represents an anion. There are no special limits with respect to the anion. Specific examples of the anion include, for example, a fluorine ion, a chlorine ion, a bromine ion, an iodine ion, a perchloric acid ion, a p-toluenesulfonic acid ion, a methanesulfonic acid ion, a tetrafluoroboric acid ion, a tetrahydroboric acid ion or a 2,4,6-trinitrophenoxide anion, etc. However, when an inner salt is formed, $X^{\ominus}$ is not present.

Furthermore, $R_3$ may connect with the ring formed with B to form a biscyclo ring system (for example, a quinuclidine ring, etc.).

The alkyl group, the substituted alkyl group, the alkenyl group, the alkoxy group, and the alkylthio group for $R_1$, $R_2$, $R_3$ and $R_4$ each preferably has total carbon atoms (including substituent(s)) of 1 to 20.

The aryl group, the substituted aryl group, the aryloxy group, and the arylthio group for $R_1$, $R_2$, $R_3$ and $R_4$ each preferably has total carbon atoms (including substituent(s)) of 6 to 20.

The nitrogen containing heterocyclic ring formed with A or B may be fused with an aryl ring (for example, a benzene ring or a naphthalene ring, etc.). The nitrogen containing heterocyclic ring may be substituted with one or more substituents. Examples of the substituents include an alkyl group or a substituted alkyl group, and preferably an alkyl group having 1 to 20 carbon atoms (for example, a methyl group, an ethyl group, an isopropyl group, a tert-butyl group, a cyclohexyl group, a dodecyl group or a hexadecyl group, etc.). The alkyl group may be substituted with one or more substituents selected from a halogen atom (for example, a chlorine atom or a bromine atom, etc.), an aryl group or a substituted aryl group (for example, a phenyl group, a 4-methylphenyl group, a 2-chlorophenyl group or a 2-methyl-4-nitrophenyl group, etc.), a hydroxy group, an alkoxy group (for example, a methoxy group, an isopropoxy group or a cyclohexyloxy group, etc.), an aryloxy group (for example, a phenoxy group, a 4-methylphenoxy group, a 3,5-dimethylphenoxy group or a 3-methoxyphenoxy group, etc.), an alkylthio group (for example, a methylthio group or an ethylthio group, etc.), an arylthio group (for example, a phenylthio group or a 4-methoxyphenylthio group, etc.), an acyl group, a nitro group, a cyano group, a carboxy group, etc. The substituted alkyl group preferably has total carbon atoms (including substituent(s)) of 1 to 20. Specific examples of the substituted alkyl group include, for example, a hydroxymethyl group, a benzyl group, a 2-chloroethyl group or a methoxyethyl group, etc.

The substitutents for the nitrogen containing heterocyclic ring further include an alkenyl group (for example, a vinyl group or an allyl group, etc.), an aryl group or a substituted aryl group (for example, a phenyl group, a 4-methylphenyl group, a 2-chlorophenyl group, a 3-methoxyphenyl group, a 2-methyl-4-cyanophenyl group, a 2-methyl-4-nitrophenyl group or a dodecylphenyl group, etc.), an alkoxy group (for example, a methoxy group, an isopropoxy group or a cyclohexyloxy group, etc.), an aryloxy group (for example, a phenoxy group, a 4-tertbutylphenoxy group, a 4-chlorophenoxy group or a 3-methylphenoxy group, etc.), an alkylthio group (for example, a methylthio group, an ethylthio group or an octylthio group, etc.), an arylthio group (for example, a phenylthio group or a 4-methoxyphenylthio group, etc.), a carbamoyl group, a sulfamoyl group, a carboxy group, a hydroxy group or a halogen atom (for example, a chlorine atom or a bromine atom, etc.). The substituted aryl group preferably has total carbon atoms (including substituent(s)) of 6 to 20.

In the case of the compound represented by general formula (I), the substituent for the nitrogen containing heterocyclic ring formed with A further includes

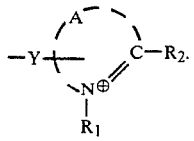

Of the above-described substituents for the nitrogen-containing heterocyclic ring, an alkyl group having 1 to 20 total carbon atoms (including substituent(s)), an aryl group having 6 to 20 total carbon atoms (including substituent(s)), a carbamoyl group, a carboxy group, and a hydroxy group are preferred.

When the compound represented by general formula (I) is a pyridinium salt, a compound having a methyl group at at least one of the 2-, 4- and 6-positions of the pyridine ring is not included in the present invention.

Of the compounds described above, the pyridinium salts represented by general formula (I) are particularly preferred. However, a pyridinium salt having a methyl group at at least one of the 2-, 4- and 6-positions of the pyridine ring does not provide the effects obtained according to the present invention. Specific examples of the compounds represented by general formula (I) or (II) used in the present invention are set forth below.

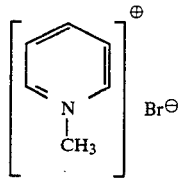

Compound 1

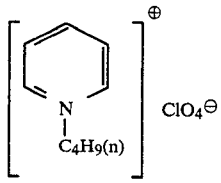

Compound 2

-continued
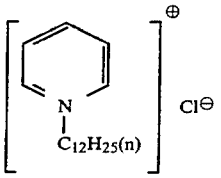
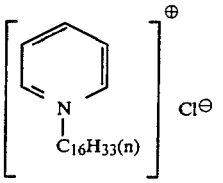
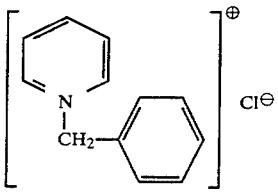
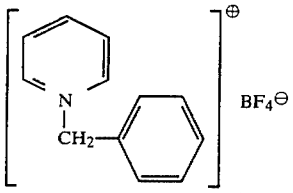
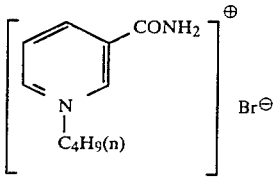
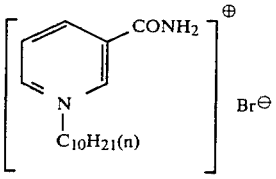
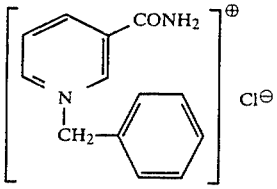
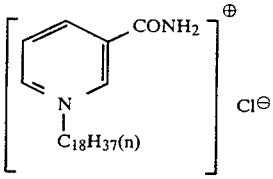
-continued
Compound 3
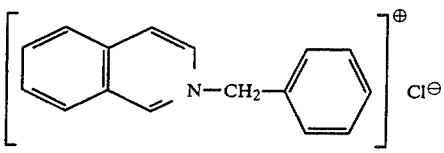
Compound 4
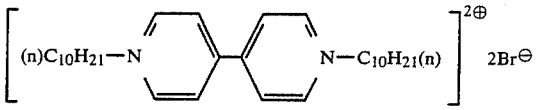
Compound 5
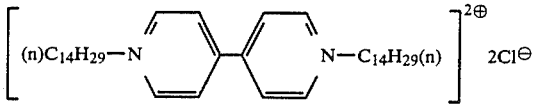
Compound 6
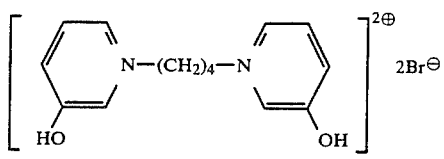
Compound 7
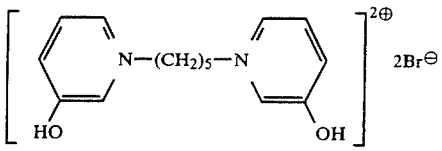
Compound 8
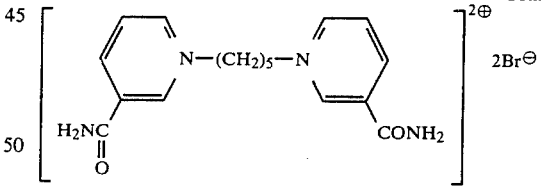
Compound 9
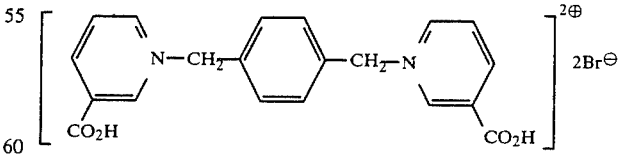
Compound 10
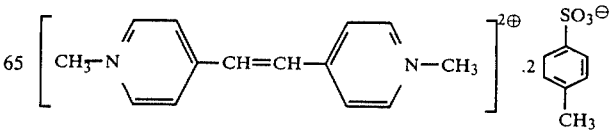
Compound 11
Compound 12
Compound 13
Compound 14
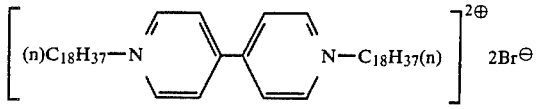
Compound 15
Compound 16
Compound 17
Compound 18
Compound 19

-continued

Compound 20

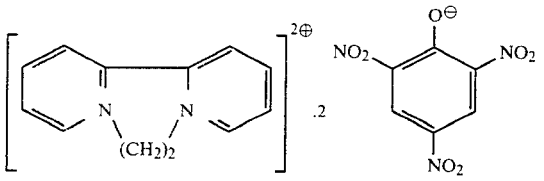

Compound 21

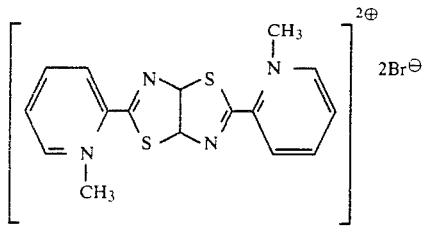

Compound 22

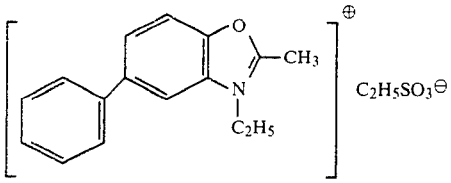

Compound 23

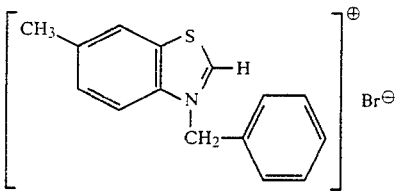

Compound 24

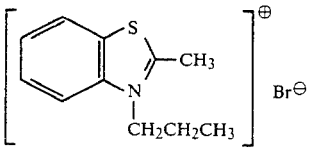

Compound 25

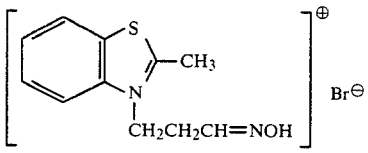

Compound 26

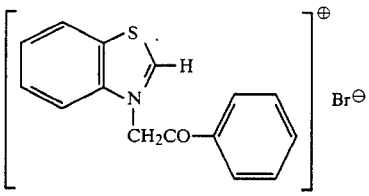

Compound 27

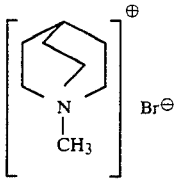

-continued

Compound 28

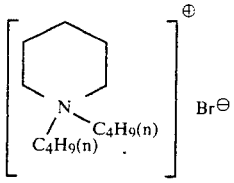

Compound 29

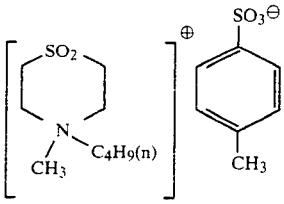

Compound 30

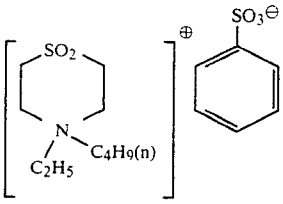

Compound 31

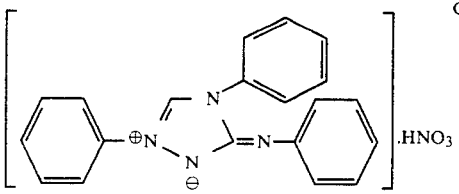

Compound 32

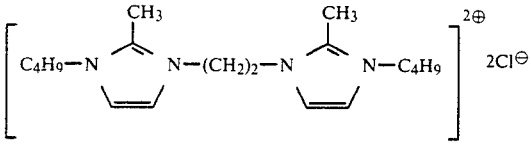

Compound 33

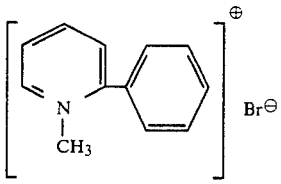

Compound 34

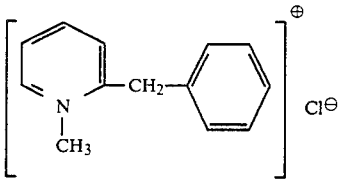

The above-mentioned compounds (I) or (II) may be synthesized by known methods. For instance, the compound (I) can be synthesized by the methods described in K. Schofield, *Hetero-Aromatic Nitrogen Compounds, Pyrroles and Pyridines,* Butterworths (London), pp. 178–198 (1967), *Photographic Science and Engineering,* Vol 15, pp. 213–229 (1971), or U.S. Pat. No. 4,135,931. The compound (II) can be synthesized by the methods described in *Journal of the American Chemical Society,* Vol. 77, p. 485 (1955), or U.S. Pat. No. 2,271,623.

The amount of the compound represented by general formula (I) or (II) according to the present invention used in the alkaline processing composition element is in the range of from about $10^{-6}$ g to about 1 g per kg of alkaline processing composition, preferably from about $10^{-4}$ g to about 1 g per kg of alkaline processing composition, and more preferably from $10^{-2}$ g to 0.8 g per kg of alkaline processing composition.

The developing agent capable of causing cross-oxidation of the above-described dye releasing redox compounds in the present invention has a one-electron oxidation reduction potential of −80 mV to −200 mV with respect to a saturated calomel electrode at a pH of 11.0.

In the present invention, any developing agent capable of causing cross-oxidation of the dye releasing redox compounds may be used if it has the above-described oxidation reduction potential. Examples of developing agents which can be used include 1-phenyl-3-pyrazolidinones, aminophenols, p-phenylenediamines and reductones.

Preferred developing agents having the above-described oxidation reduction potential are compounds represented by the following general formulae (III) and (IV), which have a one-electron oxidation reduction potential of −80 mV to −200 mV with respect to a saturated calomel electrode at a pH of 11.0.

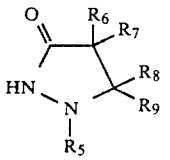

(III)

In the formula, $R_5$ represents an aryl group or a substituted aryl group. The aryl group may be substituted with one or more substituents (up to 3 substituents) selected from an alkyl group (for example, a methyl group, an ethyl group, etc.), an alkoxy group (for example, a methoxy group, an ethoxy group, etc.), a halogen atom (for example, a chlorine atom, a bromine atom, etc.), a hydroxy group, a nitro group, etc. Specific examples of the aryl group and the substituted aryl group include, for example, a phenyl group, a 4-methylphenyl group, a 4-methoxyphenyl group, a 4-chlorophenyl group, a 3-methylphenyl group, a 2-methoxyphenyl group or a 3,5-dimethylphenyl group, etc.

$R_6$, $R_7$, $R_8$ and $R_9$, which may be the same or different, each represents a hydrogen atom, an alkyl group or a substituted alkyl group. Examples of suitable alkyl groups include a methyl group, an ethyl group, an isopropyl group, a t-butyl group and a cyclohexyl group, etc., which may be substituted by one or more substituents (up to 3 substituents) such as a hydroxyl group, an acyloxy group, a tetrahydropyran-2-yloxy group, an aryl group, an alkoxy group, an aryloxy group, an alkylthio group, an arylthio group, an alkylamino group, a nitro group, a cyano group, an amino group or a halogen atom, etc. (for example, a hydroxymethyl group, an acetyloxymethyl group, a tetrahydropyran-2-yloxymethyl group, a t-butoxymethyl group, a hydroxyethyl group or a benzyl group, etc.).

$R_6$, $R_7$, $R_8$ and $R_9$ each may also represent an aryl group or a substituted aryl group. The aryl group may be substituted with one or more substituents (up to 3 substituents) selected from an alkyl group (for example, a methyl group, an ethyl group, etc.), an alkoxy group (for example, a methoxy group, an ethoxy group, etc.), a halogen atom (for example, a chlorine atom, a bromine atom, etc.), a hydroxy group, a nitro group, etc. Specific examples of the aryl group and the substituted aryl group include, for example, a phenyl group, a 4-methylphenyl group, a 3-methoxyphenyl group, a 2-hydroxyphenyl group, a 3-methyl-4-nitrophenyl group, a 4-chlorophenyl group or a naphthyl group, etc.

$R_6$, $R_7$, $R_8$ and $R_9$ each may also represent an alkoxy group (for example, a methoxy group, an isopropoxy group, a t-butoxy group or a cyclohexyloxy group, etc.), an aryloxy group (for example, a phenoxy group or a 4-methylphenoxy group, etc.), a benzyloxy group, an alkoxycarbonyl group (for example, a methoxycarbonyl group or an ethoxycarbonyl group, etc.) or a carboxy group.

The aryl group for $R_5$ preferably has 6 to 15 total carbon atoms (including substituent(s)). The alkyl group for $R_6$, $R_7$, $R_8$ and $R_9$ preferably has 1 to 10 total carbon atoms (including substituent(s)). The aryl group for $R_6$, $R_7$, $R_8$ and $R_9$ preferably has 6 to 15 total carbon atoms (including substituent(s)). The alkoxy group for $R_6$, $R_7$, $R_8$ and $R_9$ preferably has 1 to 10 carbon atoms. The aryloxy group for $R_6$, $R_7$, $R_8$ and $R_9$ preferably has 6 to 15 total carbon atoms (including substituent(s)). The alkoxycarbonyl group for $R_6$, $R_7$, $R_8$ and $R_9$ preferably has 2 to 11 carbon atoms.

Preferred examples and values of the one-electron oxidation reduction potential thereof are given in Table 1 below.

TABLE 1

| Compound Represented by General Formula (III) | pH: 11.0 mV (vs S.C.E.) |
|---|---|
| 1-Phenyl-3-pyrazolidinone | −100 |
| 4,4-Dimethyl-1-phenyl-3-pyrazolidinone | −100 |
| 4-Hydroxymethyl-4-methyl-1-phenyl-3-pyrazolidinone | −102 |
| 4-Hydroxymethyl-4-methyl-1-p-tolyl-3-pyrazolidinone | −142 |
| 4-Hydroxymethyl-4-methyl-1-(4-methoxyphenyl)-3-pyrazolidinone | −182 |
| 4,4-bis(Hydroxymethyl)-1-phenyl-3-pyrazolidinone | −110 |
| 4,4-bis(Hydroxymethyl)-1-p-tolyl-3-pyrazolidinone | −140 |

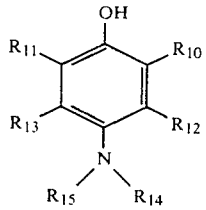

(IV)

In the formula, $R_{10}$, $R_{11}$, $R_{12}$ and $R_{13}$, which may be the same or different, each represents a hydrogen atom, a halogen atom (for example, a chlorine atom or a bromine atom, etc.), an alkyl group (for example, a methyl group, an ethyl group, an isopropyl group, a tert-butyl group or a cyclohexyl group, etc.), a substituted or unsubstituted aryl group. The aryl group may be substituted with one or more substituents (up to 3 substituents) selected from an alkyl group (for example, a methyl group, an ethyl group, etc.), an alkoxy group (for example, a methoxy group, an ethoxy group, etc.), a halogen atom (for example, a chlorine atom, a bromine atom, etc.), a hydroxy group, a nitro group, etc.

1976), xanthans or algins and the like as a viscosity increasing compound in addition to the above-described viscosity increasing compound.

The alkaline processing composition used in the present invention often preferably contains an opacifying agent as described below. For example, carbon black, titanium dioxide and light absorptive dyes, for example, indicator dyes, etc., can be used. As the indicator dye, dyes which are transparent at the time of exposure but which become colored or opaque when contacted with the alkali in the processing composition are preferred.

In the alkaline processing composition used in the present invention, pigments such as carbon black or titanium dioxide are often uniformly dispersed. In this case, known dispersing assistants or surface active agents may be used. For example, alkali metal salts of polyacrylic acid, naphthalenesulfonic acid, condensation products of naphthalenesulfonic acid and formaldehyde, polystyrenesulfonic acid, etc., can be employed.

Further, the photographic element of the present invention can contain various compounds as described below. While such can be present in the element, it is preferred to add one or more thereof to the alkaline processing composition.

The photographic element of the present invention can contain the following additives for the purpose of increasing transfer image densities. For example, aromatic alcohols such as benzyl alcohol or p-xylene-$\alpha,\alpha'$-diol, etc., as described in U.S. Pat. No. 3,846,129 can be used.

Moreover, aliphatic and alicyclic glycols and saturated aliphatic and alicyclic aminoalcohols as described in U.S. Pat. No. 4,030,920, such as 1,4-cyclohexane dimethanol, 1,6-hexanediol, 3-amino-1-propanol, 2-amino-1-propanol, 5-amino-1-pentanol, 6-amino-1-hexanol and 2-amino-2-methyl-1-propanol, etc., can be employed.

Other compounds for increasing $D_{max}$ include colloidal silica and potassium iodide, as described in *Research Disclosure,* No. 15162 (November 1976).

The photographic element of the present invention may contain the following compounds described in U.S. Pat. No. 3,942,987 in order to prevent pimple-like deformations caused after the substantial conclusion of the development. For example, alkali metal fluorides and oxalates and barium salts, etc., can be used.

In the photographic element of the present invention, it is possible to control gradation by using a competitive developing agent as described in, for example, *Research Disclosure,* No. 15162 (November 1976) in combination with the compounds of the present invention. For example, hydroquinone, methylhydroquinone, t-butylhydroquinone, etc., can be used. The above-described compounds used as competitive developing agents in the present invention have an excellent gradation-controlling function so that gradation of the toe part of the characteristic curve becomes high, as compared with that obtained using known hydroquinone, methylhydroquinone and t-butylhydroquinone. An improvement in color reproduction is also observed with an improvement in the gradation of the toe part.

The photographic element of the present invention may contain a development restrainer as described in U.S. Pat. No. 2,497,917. For example, 5-methylbenzotriazole, 5,6-dichlorobenzotriazole, 6-nitrobenzimidazole, histidine, etc., are suitable.

The dye releasing redox compounds used in the present invention can be represented by the following formula (V).

$$\text{Y-D} \qquad \text{(V)}$$

In this formula, Y represents a group which has the function of releasing a diffusible dye D (or a precursor thereof) on splitting of the dye releasing redox compound as a result of the cross-oxidation reaction which is termed a "redox center" in the art. Y generally contains a "ballast group" to render the dye releasing redox compound non-diffusible. D may represent a dye moiety itself or may contain a bonding group to link the dye to Y.

Examples of preferred dyes which can be used in the present invention include azo dyes, azomethine dyes, anthraquinone dyes, phthalocyanine dyes, indigoid dyes, triphenylmethane dyes, metal complex dyes and colored metal complexes.

Examples of Y groups which can be effectively used include N-substituted sulfamoyl groups. For example, a group represented by the following formula (A) can be used as Y.

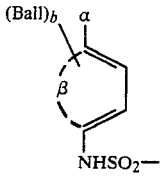

(A)

In the formula, $\beta$ represents a non-metal atomic group necessary to form a benzene ring which may be condensed with a carbocyclic or a heterocyclic ring to form, for example, a naphthalene ring, a quinoline ring, a 5,6,7,8-tetrahydronaphthalene ring or a chroman ring, etc. Further, the above-described benzene ring or ring formed by condensing the benzene ring with a carbocyclic or heterocyclic ring may be substituted with one or more of a halogen atom, an alkyl group, an alkoxy group, an aryl group, an aryloxy group, a nitro group, an amino group, an alkylamino group, an arylamino group, an amido group, a cyano group, an alkylmercapto group, a keto group, a carboalkoxy group and a heterocyclic group, etc.

$\alpha$ represents a group represented by the formula $-OG^1$ or $-NHG^2$. $G^1$ represents a hydrogen atom or a group which forms a hydroxyl group by hydrolysis and preferably represents a hydrogen atom or a group represented by the formula $$-\overset{O}{\overset{\|}{C}}G^3 \text{ or } -\overset{O}{\overset{\|}{C}}-O-G^3$$

where $G^3$ represents an alkyl group having 1 to 18 carbon atoms such as a methyl group, an ethyl group or a propyl group, etc., a halogen-substituted alkyl group having 1 to 18 carbon atoms such as a chloromethyl group or a trifluoromethyl group, etc., a phenyl group or a substituted phenyl group.

Further, $G^2$ represents a hydrogen atom, an alkyl group having 1 to 22 carbon atoms or a hydrolyzable group. A preferred hydrolyzable group represented by $G^2$ is a group represented by the formula Specific examples of the aryl group and the substituted aryl group include, for example, a phenyl group, a p-methoxyphenyl group, a p-methylphenyl group, a 2-methyl-4-nitrophenyl group, a 3,5-dimethylphenyl group or a 4-chlorophenyl group, etc.

$R_{10}$, $R_{11}$, $R_{12}$ and $R_{13}$ each may also represent an alkoxy group (for example, a methoxy group or an ethoxy group, etc.), or a substituted or unsubstituted phenoxy group (for example, a phenoxy group, a p-methylphenoxy group or a 2-methoxy-4-chlorophenoxy group, etc.).

$R_{14}$ and $R_{15}$, which may be the same or different, each represents a hydrogen atom or an alkyl group (for example, a methyl group, an ethyl group, an isopropyl group, a tert-butyl group or a cyclohexyl group, etc.). This alkyl group may be substituted with one or more substituents (up to 3 substituents) such as a halogen atom, an aryl group, a hydroxyl group, an alkoxy group, an aryloxy group, an alkylthio group, an arylthio group, an amino group, an acylamino group, an alkylamino group, a sulfonamido group, a cyano group, a nitro group, a sulfo group, a tetrahydropyran-2-yloxy group, an acyloxy group, an acyl group, or a 5- or 6-membered heterocyclic group containing at least one hetero atom selected from an oxygen atom, a nitrogen atom and a sulfur atom (for example, a tetrahydropyran-2-yl group, a furyl group, a pyridyl group, etc.), etc. Specific examples of the substituted alkyl group include, for example, a hydroxyethyl group, an ethoxyethyl group, a 4-sulfobutyl group, a tetrahydropyran-2-ylmethyl group, a methanesulfonamidoethyl group, an acetyloxyethyl group, a benzyl group or an acylaminoethyl group, etc.

Further, $R_{14}$ and $R_{15}$ each can represent a substituted or unsubstituted aryl group. The aryl group may be substituted with one or more substituents (up to 3 substituents) selected from an alkyl group (for example, a methyl group, an ethyl group, etc.), an alkoxy group (for example, a methoxy group, an ethoxy group, etc.), a halogen atom (for example, a chlorine atom, a bromine atom, etc.), a hydroxy group, a nitro group, etc. Specific examples of the aryl group and the substituted aryl group include, for example, a phenyl group, a p-methoxyphenyl group, a 2,4-dimethylphenyl group, a p-nitrophenyl group or a 2-methyl-4-chlorophenyl group, etc.

$R_{14}$ and $R_{15}$ each also can represent an acyl group, an alkoxycarbonyl group, an alkylsulfonyl group, or an arylsulfonyl group, etc.

$R_{14}$ and $R_{12}$ may also form a 6-membered ring, for example, a trimethylene group or a propenylene group, by ring closure.

Further, $R_{14}$ and $R_{15}$ may combine and form a 5- or 6-membered nitrogen containing heterocyclic ring (for example, a pyrrolidine ring, a piperidine ring or a succinic imido ring, etc.).

$R_{10}$ and $R_{12}$ may also combine and form a 6-membered hydrocarbon ring (for example, a benzene ring or a cyclohexane ring).

The alkyl group for $R_{10}$, $R_{11}$, $R_{12}$ and $R_{13}$ preferably has 1 to 10 carbon atoms. The aryl group for $R_{10}$, $R_{11}$, $R_{12}$ and $R_{13}$ preferably has 6 to 15 total carbon atoms (including substituent(s)). The alkoxy group for $R_{10}$, $R_{11}$, $R_{12}$ and $R_{13}$ preferably has 1 to 10 carbon atoms. The phenoxy group for $R_{10}$, $R_{11}$, $R_{12}$ and $R_{13}$ preferably has 6 to 15 total carbon atoms (including substituent(s)). The alkyl group for $R_{14}$ and $R_{15}$ preferably has 1 to 10 total carbon atoms (including substituent(s)). The aryl group for $R_{14}$ and $R_{15}$ preferably has 6 to 15 total carbon atoms (including substituent(s)). The acyl group for $R_{14}$ and $R_{15}$ preferably has 1 to 11 carbon atoms. The alkoxycarbonyl group for $R_{14}$ and $R_{15}$ preferably has 2 to 11 carbon atoms. The alkylsulfonyl group for $R_{14}$ and $R_{15}$ preferably has 1 to 10 carbon atoms. The arylsulfonyl group for $R_{14}$ and $R_{15}$ preferably has 6 to 15 carbon atoms.

Preferred examples and values of the one-electron oxidation reduction potential of such compounds are shown in Table 2 below.

TABLE 2

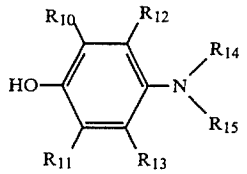

| $R_{10}$ | $R_{11}$ | $R_{12}$ | $R_{13}$ | $R_{14}$ | $R_{15}$ | pH: 11.0 mV (vs S.C.E.) |
|---|---|---|---|---|---|---|
| H | H | H | H | $C_2H_5$ | $C_2H_5$ | −81 |
| H | H | H | H | $C_2H_5$ | $C_3H_7$ | −85 |
| $C_6H_5$ | H | H | H | $C_2H_5$ | $C_2H_5$ | −110 |
| Cl | H | H | H | $(CH_2)_4$ | | −110 |
| H | H | H | H | $(CH_2)_4$ | | −130 |
| $CH_3$ | H | H | H | $CH_3$ | $CH_3$ | −146 |
| $CH_3$ | $CH_3$ | H | H | $CH_3$ | $CH_3$ | −178 |
| H | H | H | $(CH_2)_3$ | | $C_2H_5$ | −190 |

A processing composition used in the processing composition element of the present invention is a liquid composition which contains the processing components necessary to develop silver halide emulsions and to form diffusion transfer dye images or residual dye images after diffusion of a released dye(s), wherein the major component of the solvent is water which may contain other hydrophilic solvents such as methanol or 2-methoxyethanol. The processing composition contains alkali in an amount necessary to maintain the pH at a value as required for development of the emulsion layers and to neutralize acids (for example, hydrohalic acid such as hydrobromic acid, etc.) formed in the steps of development or dye image formation.

As alkaline substances in the alkaline processing composition used in the present invention, alkali metal hydroxides such as sodium hydroxide, potassium hydroxide, rubidium hydroxide or cesium hydroxide, etc., are generally used. Further, sodium carbonate and amines such as diethylamine may be used as alkalis. It is preferred that the alkali substances be present in the alkaline processing composition so that the pH thereof be about 11 or more.

The alkaline processing composition used in the present invention preferably contains a conventional viscosity increasing compound. Suitable viscosity increasing compounds which can be used are, for example, ethers which are inert to alkaline solutions, such as alkali metal salts of hydroxyethyl cellulose or carboxymethyl cellulose (for example, sodium carboxymethyl cellulose). The amount thereof advantageously is in the range of about 1 to 10% by weight based on the weight of the processing solution. The viscosity preferably is in the range of about 100 to 200,000 cps. Thus, it is possible to use polysaccharide gums such as guar gums as described in *Research Disclosure*, No. 15162 (November $$-\overset{\overset{\displaystyle O}{\|}}{C}G^4,$$

$-SO_2G^5$ or $-SOG^5$, where $G^4$ represents an alkyl group having 1 to 4 carbon atoms (such as a methyl group); a halogen-substituted alkyl group (such as a mono-, di- or trichloromethyl group or a trifluoromethyl group); an alkylcarbonyl group (such as an acetyl group); an alkoxy group; a substituted phenyl group (such as a nitrophenyl group or a cyanophenyl group); a phenoxy group which may be substituted by a lower alkyl group or a halogen atom; a carboxyl group; an alkyloxycarbonyl group; an aryloxycarbonyl group; an alkylsulfonylethoxy group; or an arylsulfonylethoxy group; and $G^5$ represents a substituted or unsubstituted alkyl group or aryl group.

Further, b is 0 or an integer of 1 or 2. However, b is 1 or 2, preferably 1, except that when an alkyl group which renders the compound represented by general formula (A) immovable or non-diffusible is introduced as $G^2$ in $-NHG^2$ in $\alpha$, namely where $\alpha$ is a group represented by $-OG^1$ or a group represented by $-NHG^2$ where $G^2$ is a hydrogen atom, an alkyl group having 1 to 8 carbon atoms or a hydrolyzable group.

Ball represents a ballast group. Suitable ballast groups are later illustrated.

Examples of the above Y groups and dye releasing redox compounds are described in Japanese Patent Application (OPI) Nos. 33826/73, 54021/79, 143230/79 and 50736/78 (the term "OPI" as used herein refers to a "published unexamined Japanese patent application").

Other examples of Y groups suitable for the above Y-D compounds are groups represented by the following formula (B).

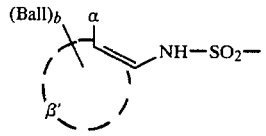

(B)

In the formula, Ball, $\alpha$ and b have the same meaning as in formula (A), and $\beta'$ represents an atomic group necessary to form a carbocyclic ring, for example, a benzene ring which may condense with a carbocyclic or heterocyclic ring to form a naphthalene ring, a quinoline ring, a 5,6,7,8-tetrahydronaphthalene ring, a chroman ring, etc. Further, the above-described various rings may be substituted with one or more of a halogen atom, an alkyl group, an alkoxy group, an aryl group, an aryloxy group, a nitro group, an amino group, an alkylamino group, an arylamino group, an amido group, a cyano group, an alkylthio group, a keto group, a carboalkoxy group and a heterocyclic group, etc. Examples of such Y groups and dye releasing redox compounds are described in Japanese Patent Application (OPI) Nos. 16131/81, 113624/76, 149328/78, 65034/79, 111344/79 and 91187/79 and U.S. Pat. No. 4,053,312.

As Y and dye repeasing redox compounds other than as above described, it is possible to use those described in Japanese Patent Application (OPI) Nos. 104343/76, 46730/78, 3819/78 and 64436/74, Japanese Patent Publication Nos. 32129/73 and 39165/73, U.S. Pat. No. 3,443,943, and Japanese Patent Application (OPI) Nos. 63618/76, 35533/78, 111628/74 and 4819/77, etc.

Ballast groups as above mentioned are organic groups which render the dye releasing redox compound nondiffusible during development in the alkaline processing solution, and are preferably groups containing a hydrophobic group having 8 to 32 carbon atoms. The organic ballast group can be bonded to the dye releasing redox compound directly or through a bonding group (for example, an imino bond, an ether bond, a thioether bond, a carbonamido bond, a sulfonamido bond, a ureido bond, an ester bond, an imido bond, a carbamoyl bond, a sulfamoyl bond or via various combinations thereof).

Suitable ballast groups are described in the above-described patent specifications (for example, in Japanese Patent Application (OPI) Nos. 33826/73 and 54021/79, etc.) containing examples of Y and dye releasing redox compound, and are well known to those skilled in the art.

The amount of the dye releasing redox compounds coated is about $1\times10^{-4}$ to about $1\times10^{-2}$ mol/m$^2$, preferably $2\times10^{-4}$ to $2\times10^{-3}$ mol/m$^2$.

The dye releasing redox compounds used in the present invention can be dispersed in one or more hydrophilic colloids as a carrier therefor using various conventional methods depending on the type of compound. For example, a compound having a dissociative group, such as a sulfo group or a carboxyl group, can be added to a hydrophilic colloid solution after dissolving such in water or an aqueous alkaline solution. A dye releasing redox compound which is scarcely soluble in aqueous media but which is highly soluble in organic solvents is dissolved in an organic solvent and the resulting solution then added to a hydrophilic colloid solution and finely dispersed therein by stirring. Suitable solvents are, e.g., ethyl acetate, tetrahydrofuran, methyl ethyl ketone, cyclohexanone, $\beta$-butoxy-$\beta$-ethoxyethyl acetate, dimethylformamide, dimethyl sulfoxide, 2-methoxyethanol and tri-n-butyl phthalate, etc. Of these solvents, those having a relatively low vapor pressure can be volatilized on drying the photographic layer or can be volatilized by a method described in U.S. Pat. Nos. 2,322,027 and 2,801,171. Of these solvents, those which are soluble in water can be removed by washing with water as described in U.S. Pat. Nos. 2,949,360 and 3,396,027.

In order to stabilize the dispersion of the dye releasing redox compound and to accelerate dye image formation, it is advantageous to incorporate a solvent which is substantially insoluble in water and has a boiling point of 200° C. or more at normal pressure in the photographic element together with the dye releasing redox compound. Solvents having a high boiling point suitable for this purpose include aliphatic esters such as higher aliphatic acid triglycerides or dioctyl adipate, phthalic acid esters such as di-n-butyl phthalate, phosphoric acid esters such as tri-o-cresyl phosphate or tri-n-hexyl phosphate, amides such as N,N-diethyl laurylamide and hydroxy compounds such as 2,4-di-n-amylphenol. Further, in order to stabilize the dispersion of the dye releasing redox compound and to accelerate dye image formation, it is advantageous to incorporate a solvent-philic polymer in the photographic element together with the dye releasing redox compound. Solvent-philic polymers suitable for this purpose are shellac; phenol-formaldehyde condensation products; poly-n-butyl acrylate; n-butyl acrylate-acrylic acid copolymers; n-butyl acrylate-styrene-methacrylamide copolymers, etc. These polymers may be dispersed in the hydrophilic colloid after dissolution in an organic solvent together with the dye releasing redox compound, or a hydrosol of the polymer prepared by emulsion polymerization, etc., may be added to a hydrophilic colloid dispersion of the dye releasing redox compound. Dispersion of the dye releasing redox compound can generally be effectively attained under a high shearing force. The dispersion of the dye releasing redox compounds can be highly promoted using surface active agents as emulsifying assistants. Surface active agents useful for dispersing the dye releasing redox compounds used in the present invention include sodium triisopropylnaphthalene sulfonate, sodium dinonylnaphthalene sulfonate, sodium p-dodecylbenzenesulfonate, sodium dioctylsulfosuccinate, sodium cetyl sulfate and anionic surface active agents as described in Japanese Patent Publication No. 4293/64. When these anionic surface active agents are used together with higher aliphatic acid esters of anhydrohexitol, particularly excellent emulsifying ability is exhibited as disclosed in U.S. Pat. No. 3,676,141.

Hydrophilic colloids which can be used for dispersing the dye releasing redox compounds used in the present invention are, for example, gelatin, colloidal albumin, casein, cellulose derivatives such as carboxymethyl cellulose or hydroxyethyl cellulose, etc., saccharide derivatives such as agar, sodium alginate or starch derivatives, etc., and synthetic hydrophilic colloids such as polyvinyl alcohol, poly-N-vinylpyrrolidone, acrylic acid copolymers, polyacrylamide and derivatives thereof (for example, partially hydrolyzed products thereof), etc. If desired, a compatible mixture of two or more of these colloids can be used. Of these colloids, gelatin is most generally used, but a part or all of the gelatin may be replaced by synthetic hydrophilic colloids.

The light-sensitive silver halide emulsions used in the present invention are hydrophilic colloid dispersions of silver chloride, silver bromide, silver chlorobromide, silver iodobromide, silver chloroiodobromide or a mixture thereof, the halogen composition of which can be suitably selected depending on the purpose of use of the photosensitive material and the processing conditions for the photosensitive material given conventional knowledge in the art. However, it is particularly preferred to use silver bromide, silver iodobromide or silver chloroiodobromide having an iodide content of 10 mol% or less and a chloride content of 30 mol% or less.

Internal latent image type silver halide emulsions which can be advantageously used in the present invention include those described in U.S. Pat. Nos. 2,592,250, 3,206,313, 3,447,927, 3,761,276 and 3,935,014, etc. Nucleus forming agents for this type of emulsion include hydrazines as described in U.S. Pat. Nos. 2,588,982 and 2,563,785, hydrazides and hydrazones as described in U.S. Pat. No. 3,227,552, and quaternary salt compounds as described in British Pat. No. 1,283,835, Japanese Patent Publication No. 38164/74 and U.S. Pat. Nos. 3,734,738, 3,719,494 and 3,615,615.

The silver halide emulsions used in the present invention may have an enhanced color sensitivity provided, if desired, by using spectrally sensitizing dyes.

It is necessary that the dye image receiving element have a mordant layer, e.g., comprising a poly-4-vinylpyridine latex (particularly, in polyvinyl alcohol) as described in U.S. Pat. No. 3,148,061, polyvinylpyrrolidone as described in U.S. Pat. No. 3,003,872 or polymers containing quaternary ammonium salts as described in U.S. Pat. No. 3,239,337 as a mordant. Other mordants which can be used are basic polymers as described in U.S. Pat. Nos. 2,882,156, 3,625,694, and 3,709,690, etc. In addition, the mordants described in U.S. Pat. Nos. 2,484,430, 3,271,147, 3,184,309 and 3,271,147, etc., can be effectively used.

In the light-sensitive elements of the present invention, silver halide emulsions and dye image providing materials are combined and at least one of the dye image providing materials is a dye releasing redox compound. Combinations of the color sensitivity of the silver halide emulsion and the spectral absorption of the dye image are appropriately selected depending on the desired color reproduction using conventional knowledge in the art. For reproduction of natural color by a subtractive process, a light-sensitive element comprising at least two combinations composed of an emulsion having selective spectral sensitivity to a certain wavelength range and a compound providing a dye image having selective spectral absorption in the same wavelength range is used. Particularly, a light-sensitive element comprising a combination of a blue-sensitive silver halide emulsion and a yellow dye releasing redox compound, a combination of a green-sensitive silver halide emulsion and a magenta dye releasing redox compound and a combination of a red-sensitive silver halide emulsion and a cyan dye releasing redox compound are useful. In order to prevent undesirable interaction between silver halide emulsion units having different spectral sensitivity, a conventional intermediate layer can be provided between the emulsions.

These combination units composed of the emulsions and the dye releasing redox compounds may be coated by superposing them in a face-to-face relationship in the light-sensitive element or may be applied as a mixture of particles (wherein a dye releasing redox compound and silver halide are present in the same particle) to form one layer.

A separation layer as described in Japanese Patent Application (OPI) No. 52056/80 may be provided between an intermediate layer and a layer containing the dye image providing material. A silver halide emulsion may also be added to the intermediate layer as described in Japanese Patent Application No. 144155/79.

As a neutralization layer, a neutralization rate controlling layer (timing layer) and a processing composition, etc., capable of use in a color diffusion transfer light-sensitive material of the present invention those as described in, for example, Japanese Patent Application (OPI) No. 64533/77 can be utilized.

It is preferred that the color diffusion transfer light-sensitive element of the present invention be a monosheet type film unit (a combination of a light-sensitive element, an image receiving element and a processing element) which is unified before, during and after exposure and which is capable of development in the light. Such film units are described in the above-mentioned *Photographic Science and Engineering* and *Neblette's Handbook of Photography and Reprography Materials, Process and Systems*, Seventh Ed. (1977), Chapter 12, etc.

The general process involved in obtaining color diffusion transfer images using dye releasing redox compounds is described in *Photographic Science and Engineering*, Vol. 20, No. 4, pages 155–164, July/August 1976.

Advantages of the present invention reside in a color diffusion transfer photographic element which rapidly forms images of high image density using a silver halide developing agent having a low oxidation reduction potential.

Compounds represented by general formula (I) or (II) used in the present invention are capable of increasing dye density without any substantial increase in silver development. This function is quite different from the function of prior quaternary salt compounds known as development accelerators and is unexpected therefrom.

Japanese Patent Publication No. 11094/63 discloses the use of onium compounds to increase maximum density ($D_{max}$) of a color diffusion transfer light-sensitive element using a dye developing agent; however, in this system, the onium compounds are used in an amount of about 10 g or more per liter of the processing solution. In distinction, the compounds represented by formula (I) or (II) per the present invention are used in an amount of 1 g or less (minimum amount: $1\times10^{-6}$ g). Thus, the function and mechanism of the compound according to the present invention differ from that of the onium compound of this Japanese patent.

The present invention will now be illustrated in more detail with reference to the following example.

EXAMPLE 1

On a transparent polyethylene terephthalate film support, there were coated, in order, the following layers to prepare a light-sensitive element.

(1) An image-receiving layer containing 4.0 g/m$^2$ of copoly-(styrene-N-vinylbenzyl-N,N,N-trihexyl ammonium chloride) and 4.0 g/m$^2$ of gelatin.

(2) A white reflection layer containing 22 g/m$^2$ of titanium dioxide and 2.2 g/m$^2$ of gelatin.

(3) An opaque layer containing 2.7 g/m$^2$ of carbon black and 2.7 g/m$^2$ of gelatin.

(4) A layer containing 0.50 g/m$^2$ of a cyan dye releasing redox compound having the following structure

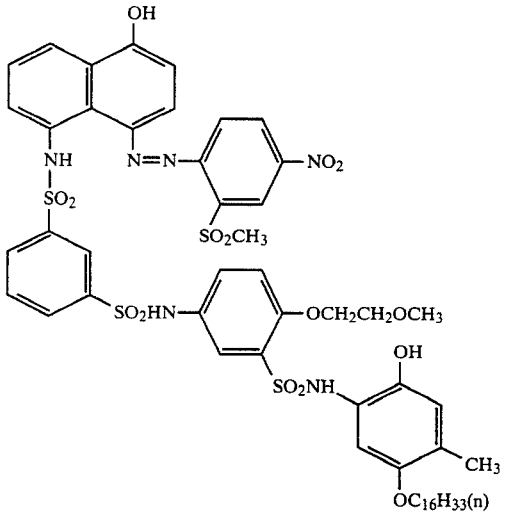

0.50 g/m$^2$ of N,N-diethyllaurylamide and 1.5 g/m$^2$ of gelatin.

(5) A layer containing a red-sensitive internal latent image type silver bromide emulsion (gelatin: 1.1 g/m$^2$, silver: 1.4 g/m$^2$), 1-acetyl-2-[4-(2,4-di-t-pentylphenoxyacetamido)phenyl]hydrazine (0.015 g/m$^2$) and sodium 2-pentadecylhydroquinone-5-sulfonate (0.067 g/m$^2$).

(6) A stain preventing layer containing gelatin (1.0 g/m$^2$), 2,5-di-t-pentadecylhydroquinone (1.0 g/m$^2$) and tricresyl phosphate (0.5 g/m$^2$).

(7) A layer containing a magenta dye releasing redox compound having the following structure (0.80 g/m$^2$)

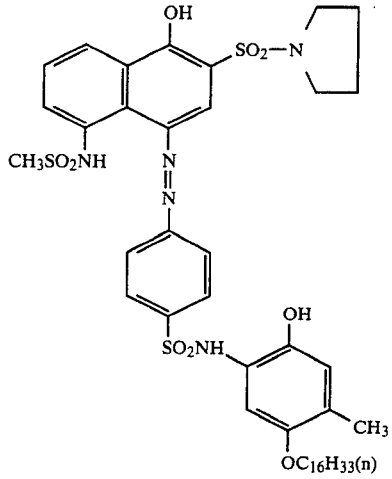

N,N-diethyllaurylamide (0.20 g/m$^2$) and gelatin (1.2 g/m$^2$).

(8) A layer containing a green-sensitive internal latent image type silver bromide emulsion (gelatin: 1.1 g/m$^2$, silver: 1.4 g/m$^2$), 1-acetyl-2-[4-(2,4-di-t-pentylphenoxyacetamido)phenyl]hydrazine (0.015 g/m$^2$) and sodium 2-pentadecylhydroquinone-5-sulfonate (0.067 g/m$^2$).

(9) A stain preventing layer containing gelatin (1.0 g/m$^2$), 2,5-di-t-pentadecylhydroquinone (1.0 g/m$^2$) and tricresyl phosphate (0.5 g/m$^2$).

(10) A layer containing a yellow dye releasing redox compound having the following structure (1.0 g/m$^2$)

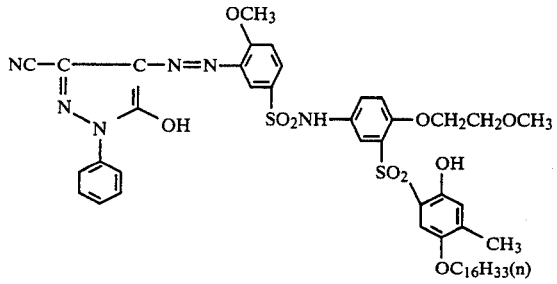

N,N-diethyllaurylamide (0.25 g/m$^2$) and gelatin (1.0 g/m$^2$).

(11) A layer containing a blue-sensitive internal latent image type silver bromide emulsion (gelatin: 1.1 g/m$^2$, silver: 1.4 g/m$^2$), 1-acetyl-2-[4-(2,4-di-t-pentylphenoxyacetamido)phenyl]hydrazine (0.015 g/m$^2$) and sodium 2-pentadecylhydroquinone-5-sulfonate (0.067 g/m$^2$).

(12) A protective layer containing 1.3 g/m$^2$ of gelatin, 0.9 g/m$^2$ of polyethylacrylate latex, 0.5 g/m$^2$ of Tinuvin and 0.026 g/m$^2$ of triacryloyl perhydrotriazine, as a hardening agent.

The above-described coating film was imagewise exposed to light through a continuous wedge using a tungsten light of 2,854° K. which was converted into light of 4,800° K. by passage through a Davis-Gibson filter. (The maximum exposure in this case was 10 C.M.S.) The exposed film was developed using the following processing solution.

Processing Composition A (Control)

| | |
|---|---|
| Potassium Hydroxide | 56 g |
| 4-Hydroxymethyl-4-methyl-1-tolyl-3-pyrazolidinone | 5.3 g |
| 5-Methylbenzotriazole | 3.5 g |
| 2-Methyl-5-isopropylhydryquinone | 0.3 g |
| Sodium Sulfite | 0.2 g |
| Benzyl Alcohol | 1.5 ml |
| Carboxymethyl Cellulose | 5.8 g |
| Carbon Black | 150 g |
| Water to make | 1 l |

Processing Composition B

Prepared by adding 10 ml of a 1% by weight aqueous solution of Compound 1 to the same composition as Processing Composition A.

Processing Composition C

Prepared by adding 10 ml of a 1% by weight aqueous solution of Compound 4 to the same composition as Processing Composition A.

Processing Composition D

Prepared by adding 30 ml of a 1% by weight aqueous solution of Compound 10 to the same composition as Processing Composition A.

Processing Composition E

Prepared by adding 10 ml of a 1% by weight aqueous solution of Compound 15 to the same composition as Processing Composition A.

Processing Composition F

Prepared by adding 30 ml of a 1% by weight aqueous solution of Compound 20 to the same composition as Processing Composition A.

Processing Composition G

Prepared by adding 10 ml of a 1% by weight aqueous solution of a compound of the formula

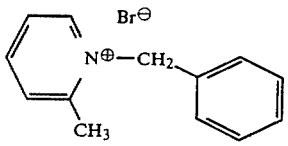

as described in Japanese Patent Publication No. 11094/63, to the same composition as Processing Composition A.

The results obtained are shown in Table 3 below.

TABLE 3

| Processing Composition | Compound | $D_{max}$ Blue | Green | Red | Remarks |
|---|---|---|---|---|---|
| A | — | 1.42 | 1.61 | 1.68 | Control |
| B | 1 | 1.50 | 1.83 | 1.74 | Invention |
| C | 4 | 1.56 | 1.75 | 1.81 | Invention |
| D | 10 | 1.51 | 1.93 | 1.78 | Invention |
| E | 15 | 1.56 | 1.78 | 1.79 | Invention |
| F | 20 | 1.50 | 1.89 | 1.72 | Invention |

TABLE 3-continued

| Processing Composition | Compound | $D_{max}$ Blue | Green | Red | Remarks |
|---|---|---|---|---|---|
| G | * | 1.01 | 1.52 | 1.60 | Comparison |

*

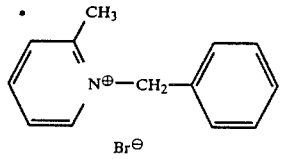

In all cases where the compound according to the present invention was used, increases in $D_{max}$ were observed as compared with the case where no such compound was used.

Further, the quaternary ammonium salt compound useful in a system using a dye developing agent (Processing Composition G) did not exhibit the effect observed in the present invention.

While the invention has been described in detail and with reference to specific embodiments thereof, it will be apparent to one skilled in the art that various changes and modifications can be made therein without departing from the spirit and scope thereof.

What is claimed is:

1. In a color diffusion transfer photographic element which comprises (a) a light sensitive element containing at least one light sensitive silver halide emulsion layer associated with a dye releasing redox compound, (b) a dye image receiving element and (c) an alkaline processing composition element, the improvement which comprises said alkaline processing composition element containing (1) a developing agent having one-electron oxidation reduction potential in the range of from −80 mV to −200 mV with respect to a saturated calomel electrode at a pH of 11.0, wherein said developing agent is a 1-phenyl 3-pyrazolidinone or an aminophenol and (2) at least one compound selected from the group consisting of compounds represented by the following general formulae (I) or (II)

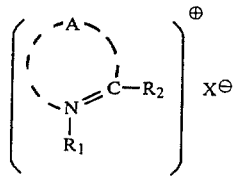

(I)

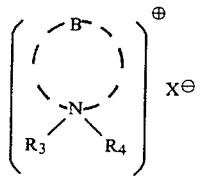

(II)

wherein A and B each represents a non-metallic atomic group necessary to form a 5-, 6- or 7-membered ring; $R_1$, $R_3$ and $R_4$ each represents an alkyl group, a substituted alkyl group, an alkenyl group, an aryl group or a substituted aryl group, wherein $R_1$ may further represent

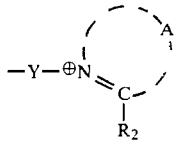

and $R_4$ may further represent

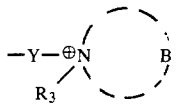

wherein Y represents a divalent group; $R_2$ represents a hydrogen atom, an alkyl group, a substituted alkyl group, an aryl group, a substituted aryl group, an alkoxy group, an aryloxy group, an alkylthio group or an arylthio group, with the proviso that $R_2$ is not a methyl group when the compound represented by general formula (I) is a pyridinium salt; and $X^{\ominus}$ represents an anion, with the proviso that $X^{\ominus}$ is not present when an inner salt is formed, wherein $R_3$ further may connect with the ring formed with B to for a biscyclo ring system, and wherein the compounds represented by formula (I) or (II) are used in an amount of from $1\times10^{-6}$ g to 1 g per kg of an alkaline processing composition.

2. The color diffusion transfer photographic element as claimed in claim 1, wherein the non-metallic atomic group is a group of 3 to 6 atoms selected from one or more of a carbon atom, an oxygen atom, a sulfur atom and a nitrogen atom.

3. The color diffusion transfer photographic element as claimed in claim 1, wherein A represents

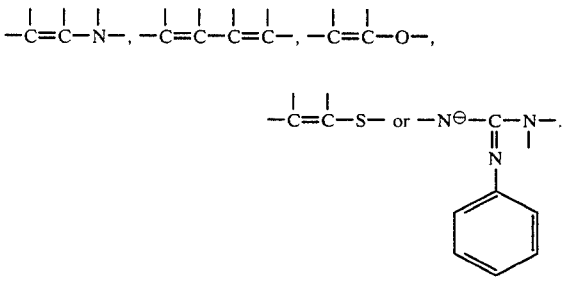

4. The color diffusion transfer photographic element as claimed in claim 1, wherein B represents a tetramethylene group, a pentamethylene group, a pentenylene group or

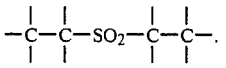

5. The color diffusion transfer photographic element as claimed in claim 1, wherein the substituted alkyl group for $R_1$, $R_3$ or $R_4$ is an alkyl group substituted with one or more substituents selected from a halogen atom, an aryl group, a substituted aryl group, a hydroxy group, a sulfonamino group, an alkoxy group, an aryloxy group, an alkylthio group, an arylthio group, an acyl group, an acylamino group, a carboxy group, a nitro group and a cyano group.

6. The color diffusion transfer photographic element as claimed in claim 1, wherein the substituted aryl group for $R_1$, $R_3$ or $R_4$ is an aryl group substituted with one or more substituents selected from a halogen atom, an alkyl group, an alkoxy group, an aryloxy group, an alkylthio group, an arylthio group, an acyl group, an acylamino group, a carboxyl group, a cyano group, a hydroxy group and a nitro group.

7. The color diffusion transfer photographic element as claimed in claim 1, wherein the divalent group for Y is an alkylene group, an arylene group, an alkenylene group or

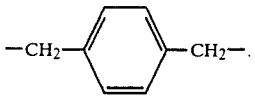

8. The color diffusion transfer photographic element as claimed in claim 1, wherein the substituted alkyl group for $R_2$ is an alkyl group substituted with one or more substituents selected from a halogen atom, an aryl group, a substituted aryl group, a hydroxy group, an alkoxy group, an aryloxy group, an alkylthio group, an arylthio group, an acyl group, a nitro group, a cyano group and a carboxy group.

9. The color diffusion transfer photographic element as claimed in claim 1, wherein the substituted aryl group for $R_2$ is an aryl group substituted with one or more substituents selected from a halogen atom, an alkyl group, an alkoxy group, a cyano group and a nitro group.

10. The color diffusion transfer photographic element as claimed in claim 1, wherein $R_2$ is a hydrogen atom or an alkyl group having 1 to 20 carbon atoms.

11. The color diffusion transfer photographic element as claimed in claim 1, wherein the nitrogen containing heterocyclic ring formed with A or B is fused with an aryl ring.

12. The color diffusion transfer photographic element as claimed in claim 1, wherein the nitrogen containing heterocyclic ring formed with A or B is substituted with one or more substituents selected from an alkyl group, a substituted alkyl group, an alkenyl group, an aryl group, a substituted aryl group, an alkoxy group, an aryloxy group, an alkylthio group, an arylthio group, a carbamoyl group, a sulfamoyl group, a carboxy group, a hydroxy group and a halogen atom.

13. The color diffusion transfer photographic element as claimed in claim 12, wherein said substituent is an alkyl group having 1 to 20 carbon atoms, an aryl group, a carbamoyl group, a carboxy group or a hydroxy group.

14. The color diffusion transfer photographic element as claimed in claim 1, wherein said compound (2) is a pyridinium salt represented by general formula (I).

15. The color diffusion transfer photographic element as claimed in claim 1, wherein said developing agent (1) is a 1-phenyl-3-pyrazolidinone of the general formula (III):

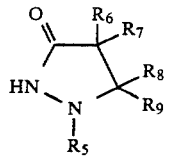

(III)

wherein $R_5$ represents an aryl group or a substituted aryl group, $R_6$, $R_7$, $R_8$ and $R_9$, which may be the same or different, each represents a hydrogen atom, an alkyl group, a substituted alkyl group, an aryl group, a substituted aryl group, an alkoxy group, an aryloxy group, a benzyloxy group, an alkoxycarbonyl group or a carboxy group.

16. The color diffusion transfer photographic element as claimed in claim 15, wherein the substituted aryl group for $R_5$ is an aryl group substituted with one or more substituents selected from an alkyl group, an alkoxy group, a halogen atom, a hydroxy group and a nitro group.

17. The color diffusion transfer photographic element as claimed in claim 15, wherein the substituted alkyl group for $R_6$, $R_7$, $R_8$ or $R_9$ is an alkyl group substituted with one or more substituents selected from a hydroxy group, an acyloxy group, a tetrahydropyran-2-yloxy group, an aryl group, an alkoxy group, an aryloxy group, an alkylthio group, an arylthio group, an alkylamino group, a nitro group, a cyano group, an amino group and a halogen atom.

18. The color diffusion transfer photographic element as claimed in claim 15, wherein the substituted aryl group for $R_6$, $R_7$, $R_8$ or $R_9$ is an aryl group substituted with one or more substituents selected from a halogen atom, an alkyl group, an alkoxy group, a hydroxy group and a nitro group.

19. The color diffusion transfer photographic element as claimed in claim 1, wherein said developing agent (1) is an aminophenol of the general formula (IV):

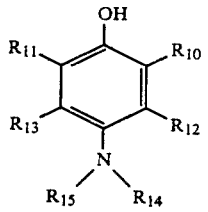

(IV)

wherein $R_{10}$, $R_{11}$, $R_{12}$ and $R_{13}$, which may be the same or different, each represents a hydrogen atom, a halogen atom, an alkyl group, a substituted or unsubstituted aryl group, an alkoxy group or a substituted or unsubstituted phenoxy group; and $R_{14}$ and $R_{15}$ which may be the same or different, each represents a hydrogen atom, a substituted or unsubstituted alkyl group, a substituted or unsubstituted aryl group, an acyl group, an alkoxycarbonyl group, an alkylsulfonyl group or an arylsulfonyl group; $R_{14}$ and $R_{12}$ may form a 6-membered ring by ring closure; $R_{14}$ and $R_{15}$ may combine and form a 5- or 6-membered nitrogen containing heterocyclic ring; and $R_{10}$ and $R_{12}$ may combine and form a 6-membered hydrocarbon ring.

20. The color diffusion transfer photographic element as claimed in claim 19, wherein the substituted aryl group for $R_{10}$, $R_{11}$, $R_{12}$ or $R_{13}$ is an aryl group substituted with one or more substituents selected from an alkyl group, an alkoxy group, a halogen atom, a hydroxy group and a nitro group.

21. The color diffusion transfer photographic element as claimed in claim 19, wherein the substituted phenoxy group for $R_{10}$, $R_{11}$, $R_{12}$ or $R_{13}$ is a phenoxy group substituted with one or more substituents selected from a halogen atom, an alkyl group or an alkoxy group.

22. The color diffusion transfer photographic element as claimed in claim 19, wherein the substituted alkyl group for $R_{14}$ or $R_{15}$ is an alkyl group substituted with one or more substituents selected from a halogen atom, an aryl group, a hydroxy group, an alkoxy group, an aryloxy group, an alkylthio group, an arylthio group, an amino group, an acylamino group, an alkylamino group, a sulfonamido group, a cyano group, a nitro group, a sulfo group, a tetrahydropyran-2-yloxy group, an acyloxy group, an acyl group and a 5- or 6-membered heterocyclic group.

23. The color diffusion transfer photographic element as claimed in claim 19, wherein the substituted aryl group for $R_{14}$ or $R_{15}$ is an aryl group substituted with one or more substituents selected from an alkyl group, an alkoxy group, a halogen atom, a hydroxy group and a nitro group.

24. The color diffusion transfer photographic element as claimed in claim 1, wherein said dye releasing redox compound is represented by the general formula (V):

$$Y\text{-}D \qquad (V)$$

wherein Y represents a group which releases a diffusible dye D or a precursor thereof on splitting of the dye releasing redox compound as a result of the cross-oxidation reaction and D represents a dye or contains a bonding group for linking the dye to Y.

25. The color diffusion transfer photographic element as claimed in claim 1, wherein said light-sensitive element (a) comprises a combination of a blue-sensitive silver halide emulsion and a yellow dye releasing redox compound, a combination of a green-sensitive silver halide emulsion and a magenta dye releasing redox compound and a red-sensitive silver halide emulsion and a cyan dye releasing redox compound.

26. The color diffusion transfer photographic element as claimed in claim 25, wherein said silver halide emulsions are internal latent image silver halide emulsions.

27. The color diffusion transfer photographic element as claimed in claim 1, wherein said dye image receiving element (b) comprises a mordant layer.

28. The color diffusion transfer photographic element as claimed in claim 1, wherein said alkaline processing composition further contains an alkali substance so that the pH thereof is about 11 or more.

29. The color diffusion transfer photographic element as claimed in claim 1, wherein said aminophenol is a tertiary aminophenol.

* * * * *